US005882500A

United States Patent [19]

Abedian et al.

[11] Patent Number: 5,882,500

[45] Date of Patent: Mar. 16, 1999

[54] PROCESS FOR DEMETALLIZING HIGHLY ACID BATHS AND USE OF SAID PROCESS FOR ELECTROPOLISHING SPECIAL STEEL SURFACES

[75] Inventors: Razmik Abedian, Oberhaching; Olaf Böhme, Schmitten; Siegfried Piesslinger-Schweiger, Vaterstetten, all of Germany

[73] Assignee: Poligrat GmbH, Munich, Germany

[21] Appl. No.: 973,700

[22] PCT Filed: Jun. 4, 1996

[86] PCT No.: PCT/EP96/02439

§ 371 Date: Mar. 4, 1998

§ 102(e) Date: Mar. 4, 1998

[87] PCT Pub. No.: WO96/41905

PCT Pub. Date: Dec. 27, 1996

[30] Foreign Application Priority Data

Jun. 9, 1995 [DE] Germany ..... 195 21 132.4

[51] Int. Cl.[6] ..... C25F 7/02

[52] U.S. Cl. ..... 205/497; 205/650; 205/673; 205/771

[58] Field of Search ..... 205/497, 496, 205/771, 650, 673

[56] References Cited

FOREIGN PATENT DOCUMENTS

3343396 A1 6/1985 Germany .

OTHER PUBLICATIONS

Metalloberflache, Nr. 12 (1958), S. 361–363, T. Zak (no month).

Chemical Abstracts, vol. 113, No. 20, 12 Nov. 1990, abstract No. 180231.

*Primary Examiner*—Arun S. Phasge

*Attorney, Agent, or Firm*—Burns,Doane,Swecker & Mathis, L.L.P.

[57] ABSTRACT

The invention relates to a process for the demetallization of highly acidic baths based on phosphoric acid and sulphuric acid, and also to a process for the electropolishing of stainless-steel surfaces, in which a regeneration of, in particular, spent electrolyte compositions for electropolishing can be achieved by separate electrolytic reduction of Fe(III) to Fe(II) and subsequent removal of precipitates.

8 Claims, 2 Drawing Sheets

PROCESS FOR DEMETALLIZING HIGHLY ACID BATHS AND USE OF SAID PROCESS FOR ELECTROPOLISHING SPECIAL STEEL SURFACES

This application is a 371 of PCT/EP96/02439 filed Jun. 4, 1996.

The invention relates to a process for the demetallization of highly acidic baths based on phosphoric and sulphuric acid.

The invention furthermore relates to the use of a demetallization process in the electropolishing of stainless-steel surfaces (non-rusting steel).

Electropolishing or electrolytic polishing is an electrochemical metal treatment process in which the metal to be polished is, as a rule, connected as anode in an electrical circuit. In this connection, the electrolyte is composed of an acid or an acid mixture. During the electropolishing, projecting irregularities (peaks, burrs) are superficially dissolved from the metal to be polished and the metal is therefore polished. Thus, the previously matt metal is smooth and bright. In the case of rust-free steels and carbon steels, phosphoric acid/sulphuric acid mixtures with additions of catalysts, inhibitors and the like are generally used as electrolytes.

During electropolishing, the objects to be polished, which are suspended on the appropriate support and contact elements or devices or are received in baskets or the like, are lowered into the electrolyte, i.e. the polishing bath and lifted out of the latter after a certain polishing time. After the bath liquid has drained off the polished surfaces, the treated objects are then immersed in rinsing baths in order to remove the electrolyte.

To treat non-rusting steels (stainless steel), electropolishing processes currently used industrially predominantly employ low-water mixtures of concentrated phosphoric acid and sulphuric acid as electrolytes. Various organic and inorganic additions are regularly added to the electrolyte to improve the polishing action, increase the current yield, reduce the current density required and avoid hexavalent chromium ions in the rinsing waters.

The metal ions removed at the workpiece surface during the electropolishing go into solution and accumulate therein with time. All the electrolytes at present used industrially have the disadvantage that their effectiveness decreases considerably starting from a certain degree of metal enrichment. The electrolyte then has to be supplemented at least partly with fresh electrolyte or completely replaced. A reliably and economically reasonable regeneration process for a spent electrolyte is not available in the prior art. Instead, the spent electrolyte is disposed of as waste. Because of the high heavy-metal content, the spent electrolyte has to be treated as hazardous waste. The same applies to the rinsing waters which accrue during the electropolishing and the sludges which accrue during their treatment. Since the available land-fill volume for hazardous waste is, as a rule, strictly limited and, in addition, waste-disposal costs are rising (if it is not already difficult to impossible in some areas to find a suitable land-fill possibility), there is a considerable need for a process which makes possible a lower waste-disposal cost.

In the prior art, it has been assumed that it is precisely said enrichment with metal ions which makes the electrolyte unusable. Consequently, after a certain metal content has been reached, usually between 4 and 5% by weight, an electrolyte has been delivered for waste disposal. Since the permissible content of phosphates and sulphates in waste water is generally strictly limited, the entire volume of even still unused acid had to be neutralized. In total, large quantities of sludge accrued during this waste disposal.

To summarize, there are consequently problems in said prior art to the effect that a) the effectiveness of the electropolishing bath decreases markedly with increasing metal enrichment and that b) the waste waters accruing during electropolishing require an expensive waste disposal.

The optimum working range in the metal content of normal electrolytes is, as a rule, between 35 g/l and 70 g/l (2–4% by weight). According to the prior art, the electrolytes are capable of working up to a metal content of approximately 100 g/l, corresponding to approximately 6% by weight. At higher metal contents, the polishing quality decreases drastically. In order to maintain the working capability, some of the electrolyte enriched with metal ions is removed and replaced by fresh, metal-free electrolyte. The enriched electrolyte is removed either continuously by means of entrainment from the electropolishing bath of electrolyte situated on the surface of the treated workpieces into the subsequent rinsing process or by direct removal. The electrolyte removed is treated either by means of a suitable waste-water treatment plant or directly in such a way that waste water resulting therefrom can be discharged into the sewage system, while the solids have, as a rule, to be land-filled as hazardous waste because of their heavy-metal content.

The invention proceeds from the idea that the metal ions have to be selectively removed from the electrolyte enriched with metal ions if an electropolishing electrolyte is to be kept permanently capable of working without partial replacement of electrolyte. Standard filtration processes (cf. DE-33 43 396 A1) are not suitable for this purpose since, after all, only solids are removed during a filtration and the concentration of metallic ions is not reduced. The processes furthermore known according to the prior art for the removal of metal ions from acidic solutions, such as ion exchange, reverse osmosis, membrane electrolysis, electrodialysis etc., cannot be applied in a simple way to electropolishing electrolytes. The membranes normally used in the prior art in electrodialysis are, for example, not resistant to highly concentrated acid mixtures. In addition, diffusion layers are formed with phosphoric acid which can severely impede, in particular, a material transport of metal ions. Said diffusion layer virtually acts as a barrier layer. Consequently, in the prior art, electrochemical processes are not carried out with highly concentrated acidic solutions. There is even a general idea that electrochemical processes are unsuitable able for the removal of iron (cf. Ullmanns Encyclopedia of Industrial Chemistry, vol. 9, pages 227–230). In addition, an auxiliary electrolyte, for example dilute ammonium sulphate solution, is generally necessary for the electrolytic deposition of iron (cf. Kerti et al., Hungarian Journal of Industrial Chemistry, vol. 1987, pages 435 et seq.), which would destroy the electropolishing electrolyte if used.

The objective of the present invention is consequently a process which makes possible the direct removal of metal ions, including iron, from the electrolytes enriched with metal ions without the electrolytes having to be appreciably diluted in the process. Ideally, the concentration of the metal ions in the depleted electrolyte should be adjusted so that the optimum working range is reached in relation to the metal concentration.

Surprisingly, it has now been found that, under certain circumstances, a demetallization can be carried out electrochemically separately from the electropolishing bath. This requires only a separate electrolysis cell, known per se, which uses a ceramic material, plastic nonwoven fabric or sintered material as separating layer. If this material having a pore size of between about 0.5 μm and 10 μm is used, a uniform layer which acts as a diaphragm is apparently formed in situ. Theoretically, a diffusion layer (about 1–5 μm) enriched with phosphoric acid can be postulated which, as such, makes possible the passage of sulphate ions for the required charge exchange, but prevents a "short circuit" due to metal ions, in particular iron ions. It was possible to achieve effective diaphragms with phosphoric acid/sulphuric acid mixtures having a mixing ratio of 1:10 to 10:1. Preferably, mixtures having a phosphoric acid to sulphuric acid ratio of 2:1 to 1:2 are used.

According to the invention, the concentrated mixtures enriched with metal ions and based on phosphoric acid and sulphuric acid are demetallized electrochemically. The metal ions are separated from the electrolyte by means of the diaphragm which is produced in situ. Pore size and structure of the partition are consequently no longer decisive for the effectiveness of the separation process and stable, relatively large-pore carrier media, such as ceramic, plastic nonwoven fabric or sintered material can be used whose pores do not become clogged because of their size and which themselves do not have a large diffusion resistance (about 0.5–10 μm). The suitable material can easily be discovered on the basis of simple experiments.

To carry out the method, an electrolysis cell (FIG. 1) is used whose anodic and cathodic regions are separated by a porous partition. When direct current is applied to the cell filled with the electrolyte to be demetallized, a diffusion layer which is depleted in sulphate ions and has a high phosphoric acid content and which impedes the passage of metal ions and acts as a separating medium is formed on the catholyte side as a result of migration of the sulphate ions into the anolyte. The higher the content of phosphoric acid in the mixture, the lower, in principle, is the exchange of metal ions through the diaphragm. However, the permeability of the diaphragm can be influenced by the temperature and the water content of the electrolyte.

In the electrolyte, the dissolved iron is originally present predominantly in the form of readily soluble Fe(III) ions. The latter are reduced in the cathode space to form substantially less soluble Fe(II) ions and then precipitate, when the solubility limit is reached, in the form of iron(II) sulphate (generally as cathode sludge). The latter can easily be removed by suitable processes, such as sedimentation, filtration, centrifugation etc., from the electrolyte. Simultaneously, nickel and chromium are also deposited. It has also proved advantageous for impurities in the electrolyte which entered it during the electropolishing to be largely bound to the sludge and also removed. This avoids an accumulation of these substances which could interfere with the electropolishing process at higher concentration.

After the precipitation, the iron content of the electrolyte is, as a rule, approximately 2.5% by weight and consequently in the ideal working range. After topping up the sulphuric acid consumed by the precipitation and adjusting to the correct density, the purified electrolyte is again capable of being used.

The process functions in a very wide mixing range of phosphoric acid and sulphuric acid and can be effectively used as soon as the metal content is above 40 g/l.

If the process according to the invention is combined with a device for the recovery of entrained electrolyte and purified water from the rinsing water, such as, for example, an evaporator in combination with a suitable rinsing water system, a waste-water-free operation of electropolishing plants is possible (FIG. 2).

The sludge accruing from the process contains the metals removed in high concentration. After suitable treatment it may optionally be supplied for reuse. The conditions are consequently created for avoiding the accrual of hazardous waste which overloads landfills to a great extent and causes high waste-disposal costs.

According to another aspect, the invention relates to a process for the demetallization of mixtures which essentially contain phosphoric acid and sulphuric acid, in which the mixture enriched with metal ions is transferred to an electrolysis cell in which Fe(III) ions are reduced to Fe(II) ions and the latter are then precipitated in the form of Fe(II) sulphate. As a result of this process, a regeneration of highly acidic electropolishing baths can be achieved separately from an ongoing electropolishing process (independently thereof).

The electrolytic process conditions of the process according to the invention correspond as a whole to those of the prior art. For example, in the polishing of stainless steel, a current density of 5–50 A/dm$^2$, preferably about 10–25 A/dm$^2$, is employed at about 40°–80° C. and with a polishing time of approximately 15 min.

The process according to the invention can be further optimized with regard to the process steps following the actual electropolishing. In particular, it is possible to design the rinsing processes subsequent to the electropolishing in such a way that the rinsing water is conveyed in a closed circuit using a cascade rinsing system with rinsing water regeneration (evaporator). The electrolyte recovered from the rinsing waters can then be fed back again to the process. These diverse advantages of the process according to the invention would not be capable of achievement with the prior art. In principle, a distillative treatment of the rinsing waters could in fact have been conceived. But this would however hardly have entailed any advantages since, after all, no effective advantages would have confronted a considerable input of energy. It is only as a result of the invention that a rinsing water regeneration becomes reasonably usable. After all, it is only in this case that an acid is obtained which can be reused for the electrolyte. In the prior art, the rinsing waters were regularly discarded together with the acid, after the latter had been neutralized.

The metal salts separated from the electrolyte during the filtration contain the heavy metals in high concentration. They can be submitted, for example, directly to a metallurgical process. The metal salts can be purified from the adhering acid residues by a treatment subsequent to the filtration, such as, for example, rinsing with ice water, that safe handling is possible.

The process according to the invention is carried out in an arrangement known per se for electrolytic polishing, having a separate electrochemical cell including the diaphragm and means for filtering the electrolysis bath. Normally, said means comprise inlet and outlet pipes which make possible a constant or discontinuous feedback of the electrolyte solution to the polishing process.

BRIEF DESCRIPTION OF THE DRAWINGS

FIG. 1 shows a demetallization device such as can be used externally, but also incorporated in an electropolishing process. The electrolyte is continuously or discontinuously fed into the electrolysis cell via suitable inlet pipes and subjected therein to an electrolysis. In the electrolysis, Fe(III) ions are reduced to Fe(II) ions and, if a certain maximum concentration (which is determined by the ionic product) is exceeded, are precipitated as iron sulphate. Since sulphate concentrations in electropolishing baths are, as a rule, high, the Fe (II) is precipitated virtually quantitatively as sulphate. The slurry or suspension from the electrolysis cell is then fed to a filter in which the iron sulphate is essentially deposited. In this process, other sparingly soluble metal salts, such as those of chromium, nickel, molybdenum or copper, are also deposited from the solution, in addition to the iron sulphate. The filtrate can then be fed back directly into an electropolishing device. Frequently, a regeneration with phosphoric acid and/or sulphuric acid is possible. However, owing to the circulation procedure indicated, this is not, as a rule, necessary.

Figure 1:
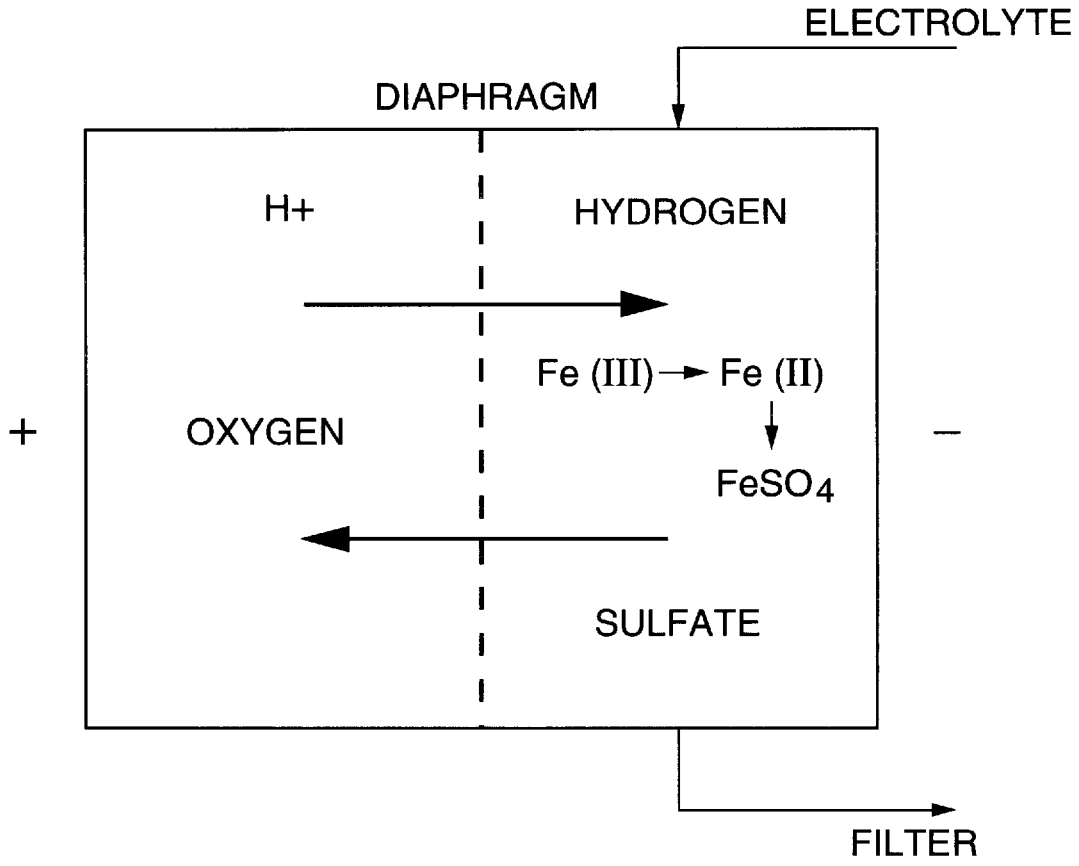
FIG. 1 shows a diagrammatic structure of a demetallizing device and illustrates the essential electrochemical reactions.
Figure 2:
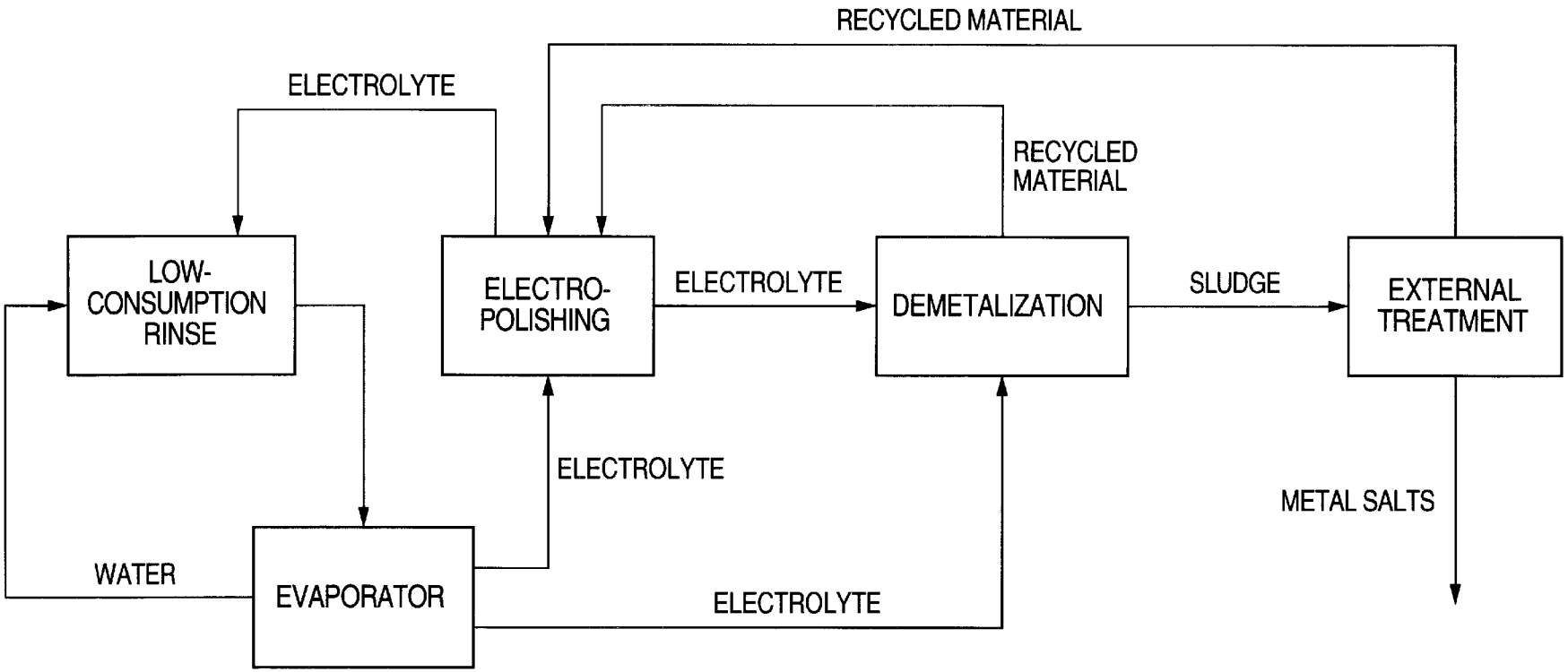
FIG. 2 shows a process flow chart of a waste-water-free electropolishing plant which uses the process according to the invention.

The process flow chart shown in FIG. 2 illustrates the particular advantages of the procedure according to the invention. Since both the electrolyte and the rinsing waters can be reused, a plant according to the invention operates virtually free of waste water. Workpieces which have been subjected to an electropolishing are rinsed essentially with water in a rinsing stage (low-consumption rinse). The waste water of the low-consumption rinse can then be fed to an evaporator which separates the electrolyte from the rinsing water distillatively so that both can separately be reused. If the electrolyte has reached a certain metal concentration in the electropolishing process, the electropolishing action, as a rule, decreases. In order to prevent this condition or to regenerate the electropolishing capability, the electrolyte is continuously or discontinuously fed to a separate demetallization system from the electrolysis bath. As described above, in the demetallization system, Fe(III) is electrochemically reduced to Fe(II) and the iron content precipitates essentially as Fe(II) sulphate. In the subsequent filtration, a sludge is then obtained which can be submitted to a further external treatment. At the same time, a regenerated electrolyte is obtained which is fed back to the electropolishing process. The external treatment depicted here in FIG. 2 is not absolutely necessary in order to keep a continuous waste-water-free electropolishing plant in operation over a long period of time. It has, however, certain advantages since acid constituents can be recovered even from said external treatment, which acid constituents then flow back into the electropolishing stage.

The process according to the invention is explained in greater detail by reference to the following examples.

EXAMPLES

A plurality of electrolyte solutions having the compositions specified below were prepared. These electrolytes were subjected to a process according to the invention and comparatively to a process according to the prior art. It was found that, in a process according to the invention with a continuous separate electrolysis and filtration of the electrolyte and feedback of the filtrate into the electrolyte, not only was it possible to achieve constant polishing results, but the latter were also maintained over a prolonged period of time.

An electrolysis cell was employed which could accommodate a volume of about 10 l. A porous ceramic plate having a pore size of about 1.0 $\mu$m served as separating material. The separate electrolysis was carried out discontinuously in batches, only the cathode space being filled with electrolyte after prior feedback of the filtrate from the cathode space of the electrolysis cell into the electropolishing device. The temperature was adjusted to 60° C. and the voltage was 3 V. Carbon rods and stainless-steel sheets were used as electrodes.

Electrolyte 1

Phosphoric acid, 85%-strength 60.0% by wt.

Sulphuric acid, 96%-strength 36.0% by wt.

Morpholinomethanediphosphoric acid 1.0% by wt.

Diethanolamine 0.5% by wt.

Water 2.5% by wt.

Electrolyte 2

Phosphoric acid, 85%-strength 54.0% by wt.

Sulphuric acid, 96%-strength 43.0% by wt.

Morpholine 1.0% by wt.

Diisopropanolamine 0.5% by wt.

Water 1.5% by wt.

Electrolyte 3

Phosphoric acid, 85%-strength 56.0% by wt.

Sulphuric acid, 96%-strength 40.0% by wt.

Nicotinic acid 1.5% by wt.

Diisopropanolamine 0.5% by wt.

Water 2.0% by wt.

Various types of stainless steel were electropolished with the abovementioned electrolytes at an electrolyte temperature of 45°–80° C. and with a current density of 5–25 A/dm$^2$, with subsequent rinsing of the parts in a multi-stage rinsing cascade with rinsing water feedback. The rinsing water from the first, most concentrated rinsing step was concentrated by distillation in a subsidiary flow and the concentrate was fed back to the electropolishing bath. The pure condensate water was used for the final rinsing in the rinsing cascade, the rinsing water circuit thereby being closed.

During the entire operating time, the electrolyte was fed in the subsidiary flow to the electrolysis cell described above and filtered, so that the entire bath volume was circulated once every 3 to 14 days, depending on bath loading. The losses of chemicals caused by the removal of sludge were topped up. A stationary state of the electrolyte resulted, with a total metal content (predominantly iron, chromium and nickel) of 2.5 to 4% by weight. Under these circumstances, the electrolyte remained capable of working and the results achieved met the quality expectations according to the current prior art. After the stationary state of the electrolyte had been reached, the entire quantity of metal removed during the electropolishing was immediately precipitated in the electrolysis as metal salt sludge and removed in concentrated form from the electrolyte by means of the filter circuit.

Separately from the above investigations, spent electrolyte solution of different composition was also demetallized. The electrolysis cell conformed to the above details. It was found that a successful demetallization is achieved for a wide variety of compositions which can be regarded as typical examples of electropolishing solutions and that the electropolishing solutions were successfully regenerated.

Illustrative Examples

Spent electrolytes of the following composition were demetallized. In this process, a polypropylene sintered material (Vyon T; 1.5 mm thick, pore diameter 0.3–5 $\mu$m) was used as partition.

1)

Density: 1.760

$H_2SO_4$: 35.1% by wt.

$H_3PO_4$: 37.8% by wt.

Iron: 4.5% by wt. 82 g/l

The demetallization took place at 60° C.//3 V//1.5 A/l//20 hours. An electrolyte of the following composition was obtained:

Density: 1.675

$H_2SO_4$: 31% by wt.

$H_3PO_4$: 38% by wt.

Iron: 2.5% by wt. 41 g/l

2)

Density: 1.760

$H_2SO_4$: 21% by wt.

$H_3PO_4$: 43% by wt.

Iron: 4.5% by wt. 80 g/l

Demetallization: 60° C.//2.5 V/1.2 A/l//20 hours

Density: 1.610

$H_2SO_4$: 17.6% by wt.

$H_3PO_4$: 45% by wt.

Iron: 2.5% by wt. 37 g/l

3)

Density: 1.750

$H_2SO_4$: 40.5% by wt.

$H_3PO_4$: 26.5% by wt.

Iron: 5% by wt. 89 g/l

Demetallization: 60° C.//3 V//1.5 A/l//18 hours

Density: 1.675

$H_2SO_4$: 35.1% by wt.

$H_3PO_4$: 28.5% by wt.

Iron: 2.5% by wt. 42 g/l

After addition of the sulphuric precipitation by precipitation and adjustment of the density to the required values, the electrolytes can be reused without problems.

We claim:

1. A process for removing Fe(III) from a liquid composition comprising phosphoric acid, sulfuric acid and Fe(III) ions comprising:

providing an electrolysis cell, said cell having an anodic region and a cathodic region separated from one another by a partition formed of a material with a pore size of between 0.5 $\mu$m and 10 $\mu$m and capable of forming in situ a metal ion-impeding diaphragm when a direct current is applied across said cell;

feeding said liquid composition to said cathodic region;

applying direct current across said cell thereby reducing said Fe(III) ions to Fe(II) ions and forming in said cathodic region a precipitate of $FeSO_4$ from said Fe(II) ions and said sulfuric acid; and removing said precipitate from said cathodic region.

2. The process of claim 1 wherein said liquid composition is stainless-steel electropolishing electrolyte.

3. In an electropolishing process for a stainless steel surface in which an iron-containing stainless steel object having said surface is contacted in an electropolishing zone as an anode with a liquid electrolyte comprising phosphoric acid and sulfuric acid under electrolysis conditions such that iron present on the surface to be electropolished is oxidized to Fe(IIII) and dissolves in said electrolyte thereby forming an electropolished object and Fe(III)-containing liquid electrolyte, the improvement comprising:

providing an electrolysis cell, said cell having an anodic region and a cathodic region separated from one another by a partition formed of a material with a pore size of between 0.5 $\mu$m and 10 $\mu$m and capable of forming in situ a metal ion-impeding diaphragm when a direct current is applied across said cell;

removing said Fe(III)-containing liquid electrolyte from said electropolishing zone to said cathodic region;

applying direct current across said cell thereby reducing said Fe(III) ions to Fe(II) ions and forming in said cathodic region a precipitate of $FeSO_4$ from said Fe(II) ions and said sulfuric acid, and an Fe(III-reduced liquid electrolyte;

removing said precipitate from said cathodic region; and removing said Fe(III)-reduced liquid electrolyte from said cathodic region.

4. The process of claim 3 wherein the Fe(III)-reduced liquid electrolyte removed from said cathodic region is recycled to said electropolishing zone as liquid electrolyte.

5. The process of claim 3 wherein said Fe(III)-containing electrolyte is continuously removed from said electropolishing zone.

6. The process of claim 3 wherein said Fe(III)-containing electrolyte is periodically removed from said electropolishing zone.

7. The process of claim 3 wherein the electropolished object is removed from the electropolishing zone together with residual electrolyte and rinsed with water thereby forming a rinsed electropolished object and electrolyte-containing rinse water.

8. The process of claim 7 wherein electrolyte present in said electrolyte-containing rinse water is recycled to said electrolysis zone.

* * * * *